US006553678B1

(12) United States Patent
Austin

(10) Patent No.: US 6,553,678 B1
(45) Date of Patent: Apr. 29, 2003

(54) AUSTIN TRIANGLE

(75) Inventor: Kenneth H Austin, P.O. Box 1552, Manila, AR (US) 72442

(73) Assignee: Kenneth H Austin, Manila, AR (US)

( * ) Notice: Subject to any disclaimer, the term of this patent is extended or adjusted under 35 U.S.C. 154(b) by 215 days.

(21) Appl. No.: 09/630,948

(22) Filed: Aug. 3, 2000

Related U.S. Application Data

(60) Provisional application No. 60/161,607, filed on Oct. 26, 1999.

(51) Int. Cl.[7] ..... B43L 7/033

(52) U.S. Cl. ..... 33/482; 33/1 V; 33/1 AP; 434/211

(58) Field of Search ..... 33/482, 1 V, 1 AP, 33/1 SB, 1 SA, 121, 122, 562, 563, 565; 434/211, 213, 214; 702/155, 156

(56) References Cited

U.S. PATENT DOCUMENTS

| | | | | | |
|---|---|---|---|---|---|
| 1,600,666 | A | * | 9/1926 | Dugan | 33/482 |
| 1,732,073 | A | * | 10/1929 | Turner | 33/1 AP |
| 2,593,914 | A | * | 4/1952 | Palitto | 33/482 |
| 3,370,354 | A | * | 2/1968 | Schiff | 33/1 AP |
| 5,201,783 | A | * | 4/1993 | Peters | 33/474 |

* cited by examiner

*Primary Examiner*—Christopher W. Fulton

(57) ABSTRACT

I have discovered it is possible to find an indirect measurement if the vertex angle is given and the sides and the diameter are given. Using an instrument having the shape of an isosceles triangle it is possible to have a vertex angle and two congruent sides that correspond to the diameter of a circle or the side of a cube to find an indirect measurement to solve four classic problems, one is squaring the area of a circle, two is squaring the area of a sphere, three is finding the cube root of a sphere and cubing the volume, four is to double the volume of a cube.

4 Claims, 6 Drawing Sheets

AUSTIN TRIANGLE

CROSS REFERENCE TO RELATED APPLICATIONS

Provisional application # 60/161,607 filed Oct. 26, 1999

FEDERALLY SPONSORED RESEARCH OR DEVELOPMENT

Not Applicable

MICROFICHE APPENDIX

Not Applicable

BACKGROUND OF THE INVENTION (1) Field of the Invention

The invention disclosed here generally pertains to the fields of geometry and trigonometry, and commercial applications thereof.

(2) Description of the Related Information Disclosed Under 37 C.F.R. 1.97 and 1.98.

The Austin triangles are similar in some ways to the slide rule. The slide rule consist of graduated scales capable of relative movement which can do simple calculations mechanically. In ordinary slide rules the operations include multiplication, division and extraction of square roots. The Austin triangles are different in that it has no moving parts and is used directly with an object or the "footprint" of an object to calculate the area of a circle squared, square root of a sphere, cube root of a sphere, and double the volume of a sphere and a cube The protractor is limited in accuracy and would be cumbersome to use compared to the Austin trianglesin rapid extraction of square roots and cube roots. The slide rule works the formulas however, it cannot find angles of degree. The slide rule and protractor are related to the new invention but is limited in solving specific problems solved by the new invention.

The protractor is an instrument used for drawing and measuring angles. The protractor has the shape of a half circle that is marked with degrees. The Austin triangles use angles to calculate measurements of drawings and objects,

BRIEF SUMMARY OF THE INVENTION

In the most general terms the invention disclosed herein comprises an important concept of simplifying mathematical calculations.

The invention consists of a graduated scale on a vertex angle of isosceles triangles capable of rapid extraction of the square area of a circle, square root of a sphere, doubling the volume of a cube, cubing the volume of a sphere, doubling the volume of a sphere.

There are several classic problems in geometry (and applications thereof) that the invention disclosed herein, dubbed the "Austin triangles", can solve:

1. Square the area of the circle. In other words, converting the area of a circular surface to a square surface having the same area as the circle.
2. Square the area of the sphere. In other words, converting the area of a spherical structure to cuboidal structure having the same area as the sphere.
3. Finding the cubed root of the volume of a sphere.
4. Double the volume of a cube.
5. Double the volume of a sphere.

These problems can be solved with the use of an isosceles triangle and four new formulas that will solve each problem that was developed by the inventor of this instrument.

Problem 1. Finding the square root of an area of a circle; the new formula a=d*0.886.

Problem 2. Finding the square root of an area of a sphere, the new formula a=d*1.772.

Problem 3. Finding the cube root of the volume of a sphere; the new formula v=d*0.80585.

Problem 4. Finding the cubed root of a cube that equals, double the volume of a cube. The new formula v=d*1.25992105.

Problem 5. Finding the cubed root of a sphere equals, double the volume of a sphere. Use problem three to solve cube root of a sphere, then use problem four to double volume.

Problem 1. Is to find the side of a square that is congruent to the area of a circle squared. I have discovered using the isosceles with the vertex angle of 52.589 and the diameter of the circle being congruent to each of the two corresponding sides of the isosceles triangle will multiply the base by 0.886 to equal the square root of the area of the circle square.

Problem 2. After you have the squared root of the area of the circle it is possible to multiply the base by two and get the square root of the area of the sphere squared. Formula to use is a=d*0.886*2, or a=d*1.772. Now it is possible to square the area of a circle and sphere.

Problem 3. In the process of problem one I discovered it is possible to find an indirect measurement, if the angle of the vertex is given. You can find the cubed root of the volume of the sphere; the problem is to find the side of a cube that is congruent to the volume of a sphere cubed. Using the isosceles with the vertex angle of 47 degrees and the diameter of the sphere being congruent to each of the sides will multiply the base by 0.80585 to equal the cube root of the volume cubed.

Problem 4. Is a classic, the problem is to find the side of a cube that is twice the volume of a given cube. I have discovered by using an isosceles with the vertex angle of 78.09 and the side of a cube being congruent to each of the two corresponding sides of the isosceles triangle will multiply the base by 1.25992105 to equal the cubed root of a cube having the volume of the cube doubled. Now it is possible to double the volume of a sphere when you find the cube root using the formula v=d*0.80585, then use the formula v=a+a*1.25992

For triangle # 2; the vertex angle (21) is 47 degrees; the formula for converting a sphere volume to a cube format is v=*0.80585

For triangle # 3: the vertex angle is 78.09 degrees; the formula for doubling the volume to a cube format is v=c*1.25992105, when c is the length of the side of a cube.

Figure 1:
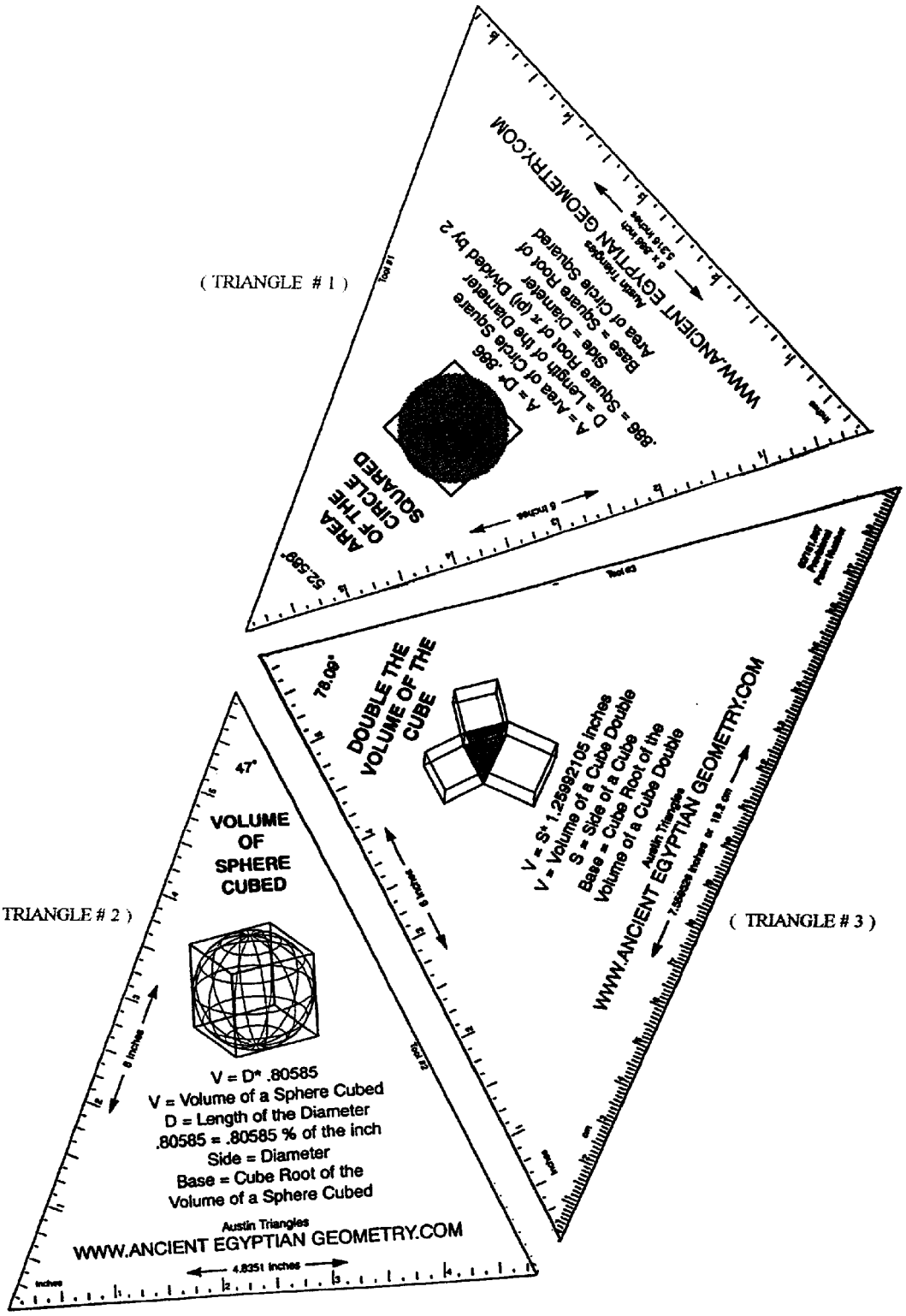
FIG. 1 is an exploded top plan view of the invention, depicting three triangular subsections that are essentially permanently joined together to yield one version of the apparatus disclosed herein. All three triangles have the shape of an isosceles triangle. However, all three triangles have different vertex angles. For triangle # 1: the vertex angle (11)=52.589 degrees; the formula for converting a circular area to a square format is A=d*0.886, where A is the area of the circle/square, D is the length of the the circle's diameter, *=the sign for multiplication; 0.886 is the square root of pi (pi is 3.14).
Figure 2:
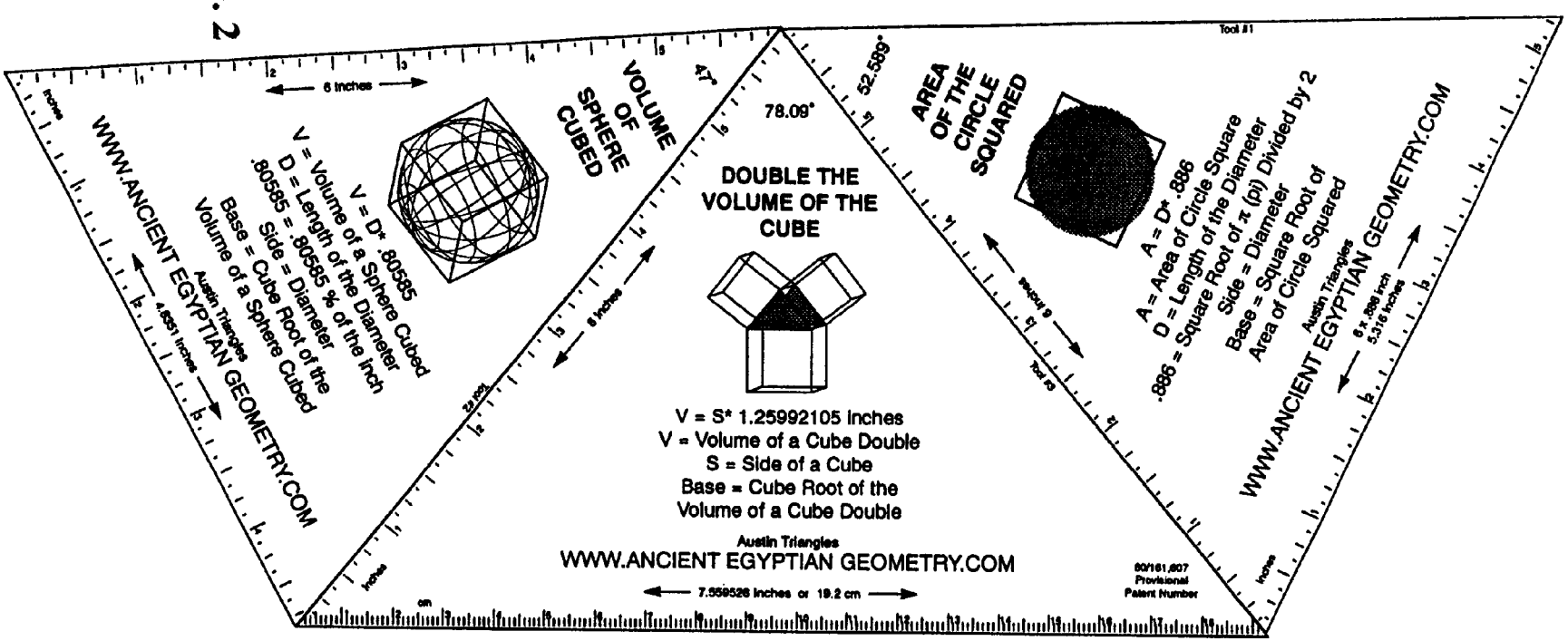

FIG. 2, is a top view of the three triangles joined together at 75% of scale.

Figure 3:
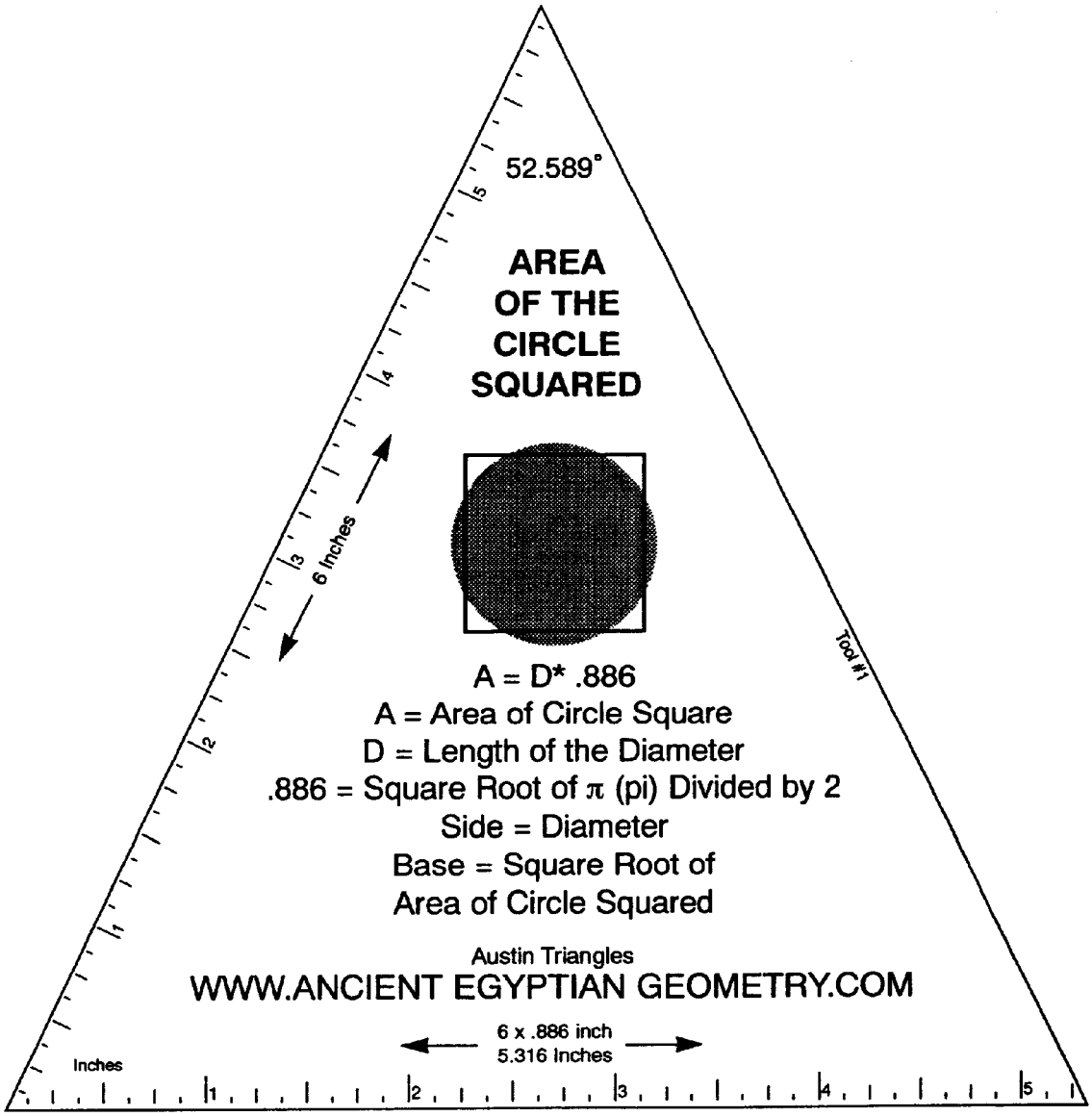

FIG. 3, is a top view of a subsection with the shape of an isosceles triangle # 1 with the vertex angle of 52.589 degrees, containing a graduated scale on the adjacent side. It has a graduated scale on the hypotenuse.

Figure 4:
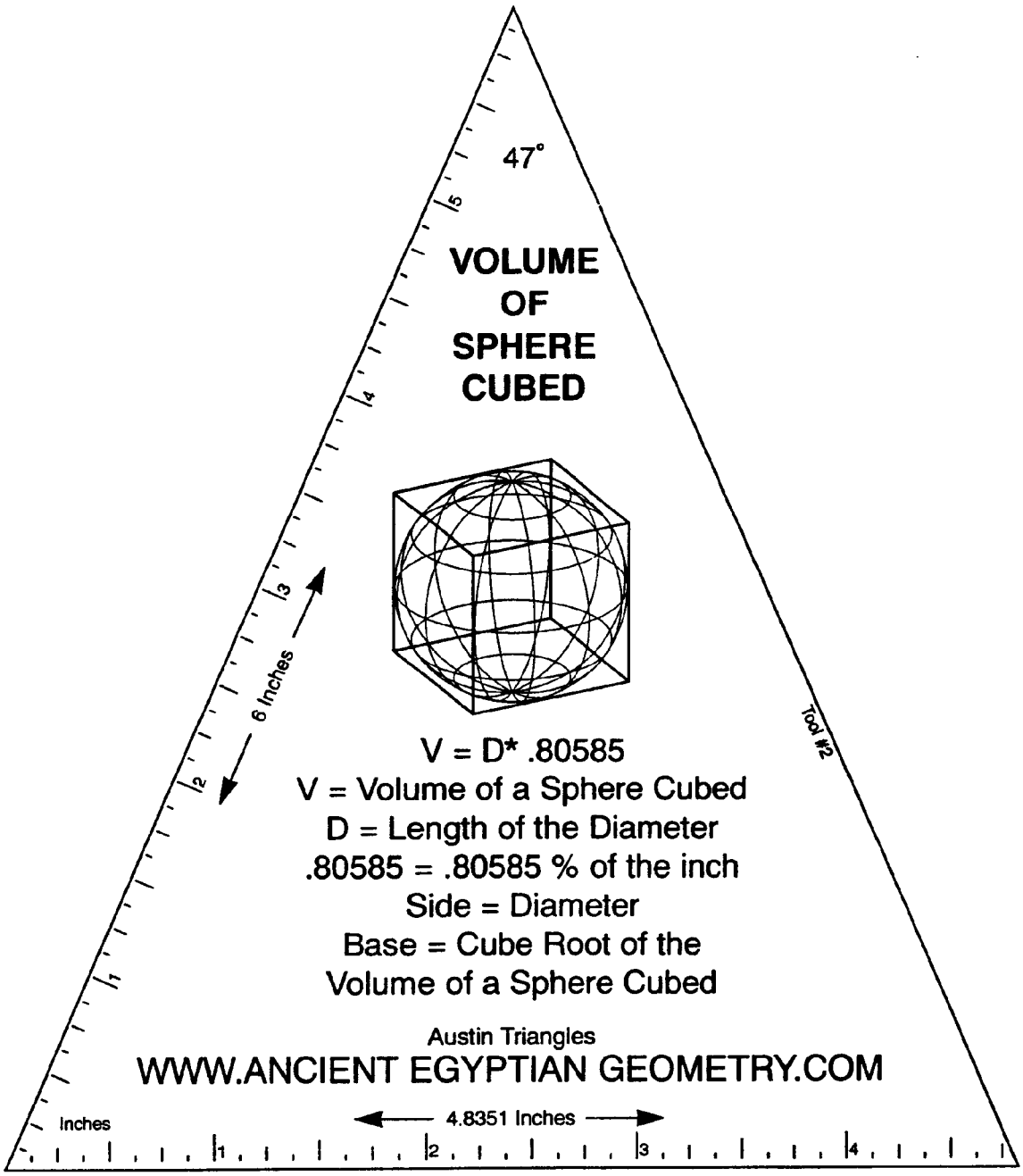

FIG. 4, is a top view of a subsection with the shape of an isosceles triangle # 2 with the vertex angle of 47 degrees, containing a graduated scale on the adjacent side. It has a graduated scale on the hypotenuse.

Figure 5:
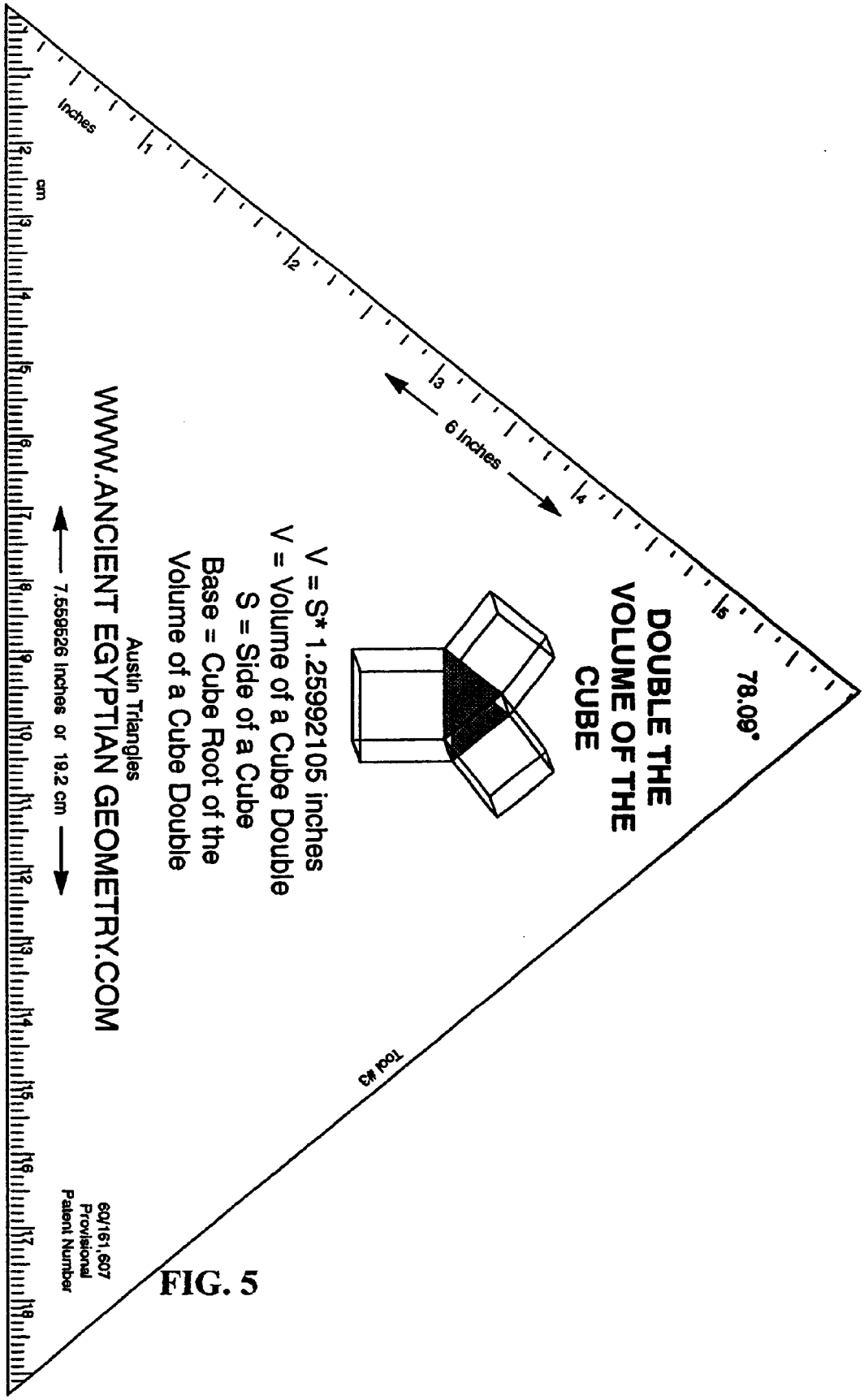

FIG. 5, is a top view of a subsection with the shape of an isosceles triangle # 3 with the vertex angle of 78.09 degrees, containing a graduated scale on the adjacent side. It has a graduated scale on the hypotenuse.

Figure 6:
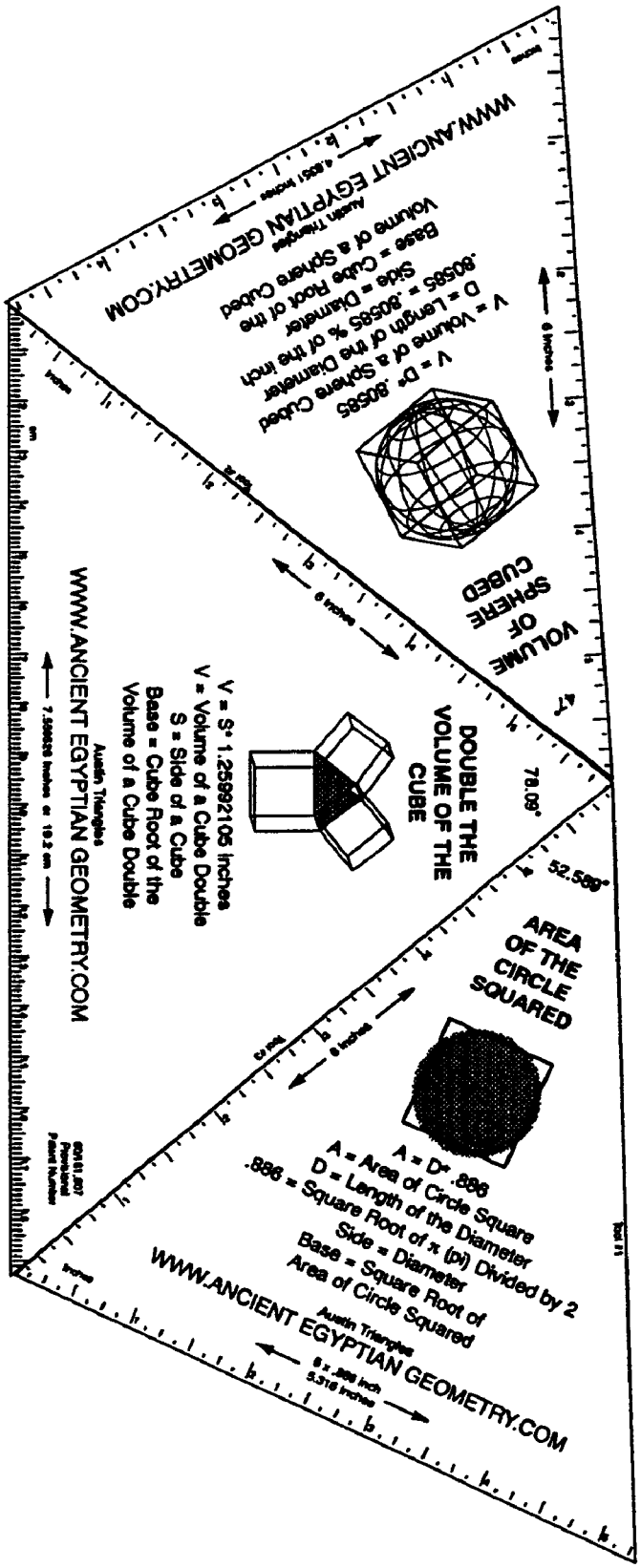

FIG. 6, is the top view of the three triangles joined together at 50% of scale.

DETAILED DESCRIPTION OF THE INVENTION

In most general terms, the invention disclosed herein includes an instrument depicting three triangular subsections that are essentially permanently joined together to yield one apparatus disclosed herein. All three have the shape of an isosceles triangle. However, all three triangles have different vertex angles. FOR TRIANGLE # 1: The vertex angle= 52.589 degrees; the triangle is used for converting a circular area to a square format. FOR TRIANGLE # 2: The vertex angle=47 degrees; the triangle is used for converting a sphere volume to cube format. FOR TRIANGLE # 3: The vertex angle=78.09 degrees; the triangle is used for converting the cube volume to a cube double in volume format.

1. For converting the area of a circle to the area of a square (such as, for determining the floor space of a surface having a circular cross section, such as the floor or "footprint" of a grain silo.) Multiplying the diameter of the circular surface by 0.886 calculates the length of each side of a square area as the circular surface.
2. For converting a spherical structure into a cuboidal structure having the same volume as the sphere. Multiplying the volume of the spherical structure by 0.80585 times the length of the diameter of the sphere, will calculate the length of each side of a cuboidal structure having the same volume as the sphere.
3. For doubling the volume of a cuboidal structure, multiply the cuboidal structure's side by 1.25992105.

What is claimed is:

1. An apparatus for converting measurements of circular areas to corresponding square areas, comprising an isosceles triangle having a vertex angle of 52.589 degrees, wherein the adjacent and opposite sides of the isosceles triangle are always congruent and the hypotenuse will always equal the square root of the area of a circle with a diameter congruent to the adjacent and/or opposite side of the vertex angle of the isosceles triangle.

2. The apparatus of claim 1 above wherein the hypotenuse when multiplied by two will always equal the square root of an area of a sphere having the same diameter of the circle.

3. An apparatus for converting measurements of spherical volumes to corresponding cuboidal volumes, comprising an isosceles triangle having a vertex angle of 47 degrees, wherein the adjacent and opposite sides of an isosceles triangle are always congruent and the hypotenuse will always equal the cube root of a sphere with a diameter congruent to the adjacent and/or opposite sides.

4. An apparatus for doubling the volume of a cuboidal structure, comprising an isosceles triangle having a vertex angle of 78.09 degrees, wherein the adjacent and/or opposite sides are always congruent and the hypotenuse will always equal the cube root of a cube doubled in volume to a cube that has sides congruent to the adjacent and/or opposite sides of an isosceles triangle.

* * * * *